US008561791B2

(12) United States Patent
Bebejian

(10) Patent No.: US 8,561,791 B2
(45) Date of Patent: Oct. 22, 2013

(54) BALANCED LINK FOR DRY COAL EXTRUSION PUMPS

(75) Inventor: Maral Bebejian, Simi Valley, CA (US)

(73) Assignee: Pratt & Whitney Rocketdyne, Inc., Sacramento, CA (US)

( * ) Notice: Subject to any disclaimer, the term of this patent is extended or adjusted under 35 U.S.C. 154(b) by 350 days.

(21) Appl. No.: 12/911,969

(22) Filed: Oct. 26, 2010

(65) Prior Publication Data

US 2012/0097506 A1 Apr. 26, 2012

(51) Int. Cl.
*B65G 17/40* (2006.01)

(52) U.S. Cl.
USPC ..... 198/853; 198/851

(58) Field of Classification Search
None
See application file for complete search history.

(56) References Cited

U.S. PATENT DOCUMENTS

| | | | | |
|---|---|---|---|---|
| 516,702 | A | 3/1894 | Franklin | |
| 930,798 | A | 8/1909 | Roberts | |
| 1,136,578 | A | 4/1915 | Ayres | |
| 1,174,965 | A | 3/1916 | Brown | |
| 1,519,165 | A | 12/1924 | Pilliner | |
| 1,740,607 | A | 12/1929 | Leary | |
| 1,758,397 | A | 5/1930 | Harber | |
| 1,769,336 | A | 7/1930 | Detaint et al. | |
| 1,824,756 | A | 9/1931 | Welser, Jr. | |
| 2,333,926 | A | 11/1943 | Hapman | |
| 2,395,761 | A | 2/1946 | Reed | |
| 2,421,750 | A | 6/1947 | Gannett | |
| 2,628,705 | A | 2/1953 | Kline et al. | |
| 2,792,928 | A | 5/1957 | Holz | |
| 2,954,113 | A | 9/1960 | Hibbard et al. | |
| 3,034,638 | A | 5/1962 | Franz | |
| 3,081,658 | A | 3/1963 | Witschi | |
| 3,840,112 | A | 10/1974 | Hartwig | |
| 4,218,025 | A | 8/1980 | Andrews | |
| 4,729,469 | A * | 3/1988 | Lapeyre et al. | 198/834 |
| 6,390,285 | B2 * | 5/2002 | de Geus et al. | 198/732 |
| 7,325,674 | B2 | 2/2008 | Dufhaus | |
| 7,958,991 | B2 * | 6/2011 | Magaldi | 198/850 |
| 2010/0012456 | A1 | 1/2010 | Magaldi | |
| 2010/0320061 | A1 * | 12/2010 | Saunders et al. | 198/626.1 |

* cited by examiner

*Primary Examiner* — Kavel Singh
(74) *Attorney, Agent, or Firm* — Carlson, Gaskey & Olds P.C.

(57) ABSTRACT

A link which defines a link body that includes a multiple of link plates integral with a link body, the link body disposed at least partially forward of a forward edge of the multiple of link plates.

20 Claims, 8 Drawing Sheets

BALANCED LINK FOR DRY COAL EXTRUSION PUMPS

STATEMENT REGARDING FEDERALLY SPONSORED RESEARCH OR DEVELOPMENT

This disclosure was made with Government support under DE-FC26-04NT42237 awarded by The Department of Energy. The Government has certain rights in this disclosure.

BACKGROUND

The present disclosure relates to a dry coal extrusion pump for coal gasification, and more particularly to a track therefor with a load balanced link.

The coal gasification process involves conversion of coal or other carbon-containing solids into synthesis gas. While both dry coal and water slurry are used in the gasification process, dry coal pumping may be more thermally efficient than current water slurry technology. In order to streamline the process and increase the mechanical efficiency of dry coal gasification, the use of dry coal extrusion pumps has steadily become more common in dry coal gasification.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1A:
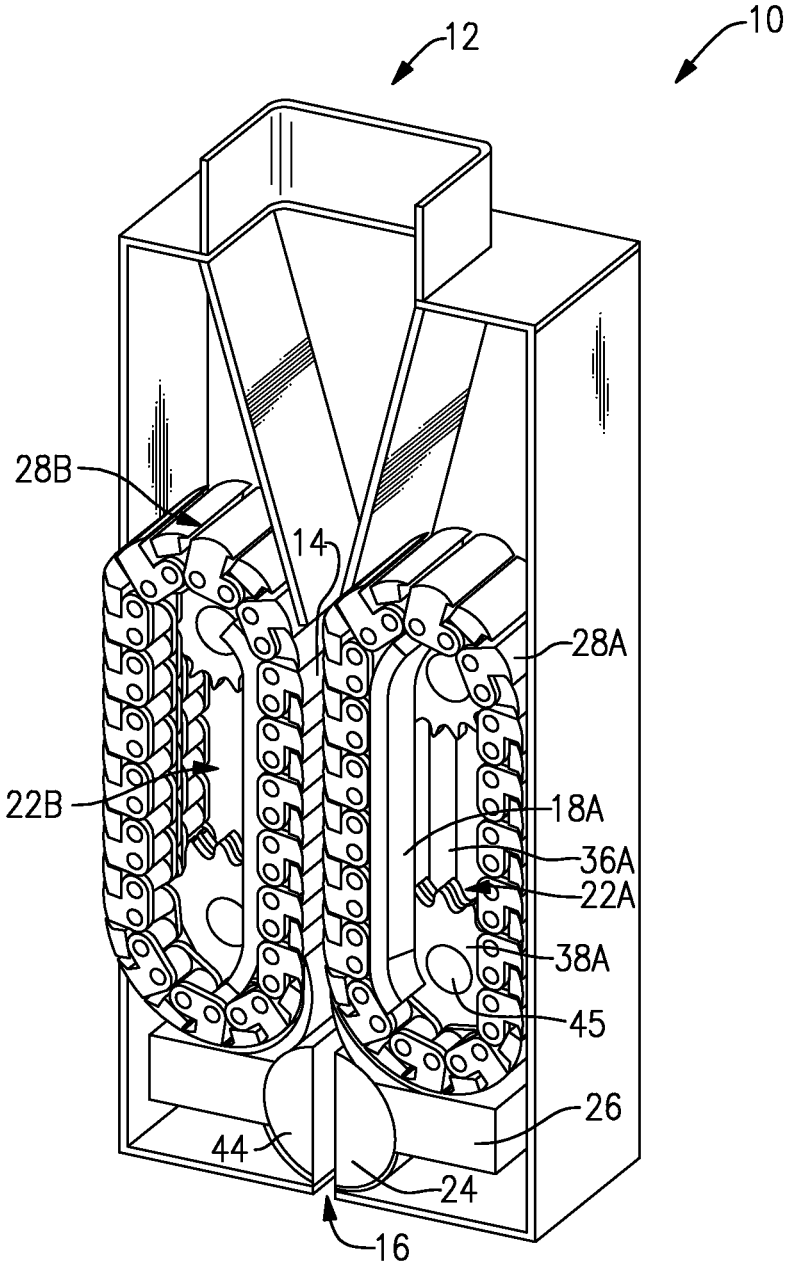
FIG. 1A is a perspective view of a dry coal extrusion pump.
Figure 1B:
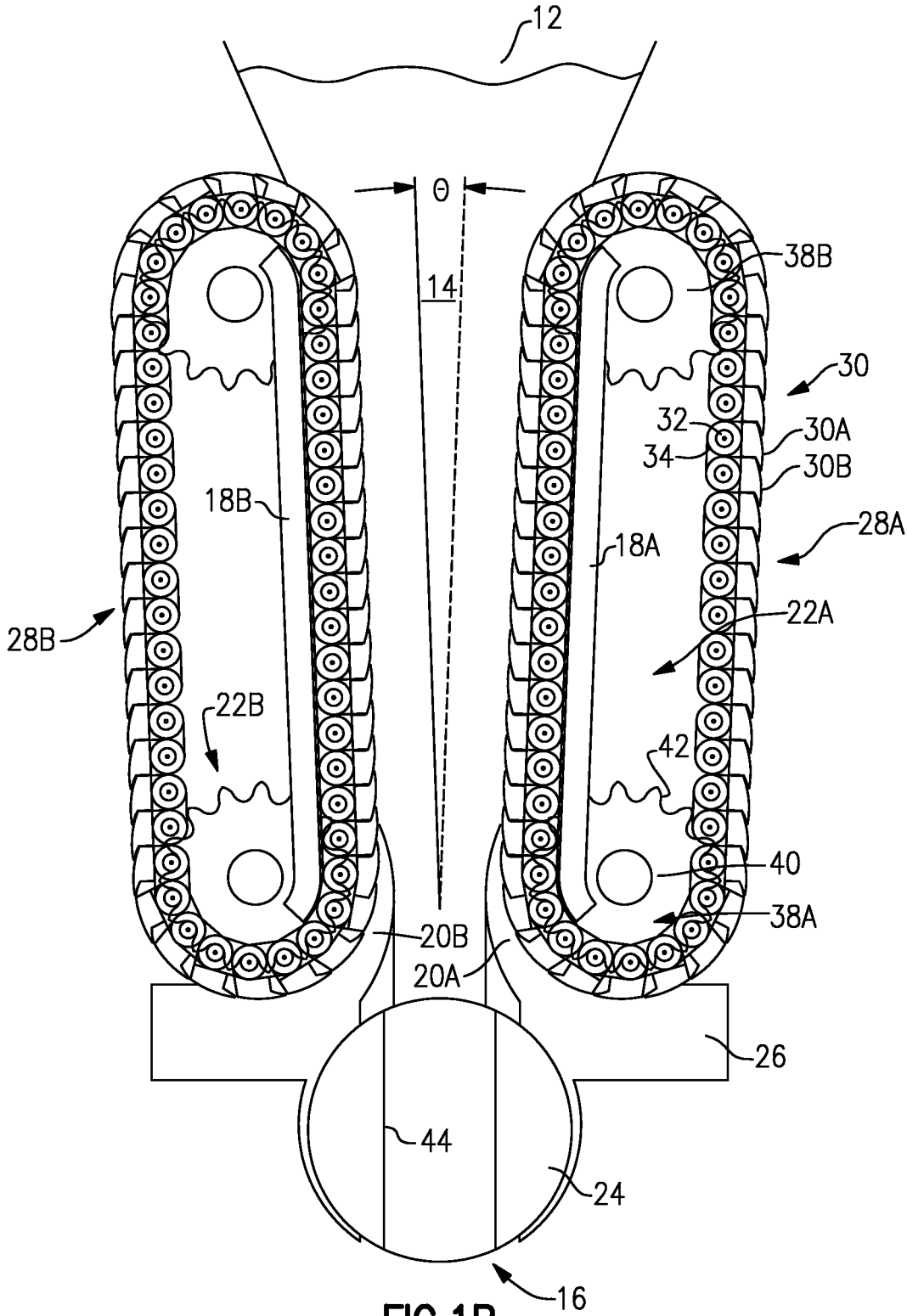
FIG. 1B is a front view of the dry coal extrusion pump.

FIGS. 1A and 1B schematically illustrate a perspective and front view, respectively, of a dry coal extrusion pump 10 for transportation of a dry particulate material such as pulverized dry coal. The dry coal extrusion pump 10 operates in a vertical or upright manner. Although pump 10 is discussed as transporting pulverized dry coal, pump 10 may transport any dry particulate material and may be used in various industries, including, but not limited to petrochemical, electrical power, food, and agricultural. It should be understood that "dry" as utilized herein does not limit the pump 10 from use with particulate material which may include some liquid content, e.g., damp particulate materials.

Figure 2:
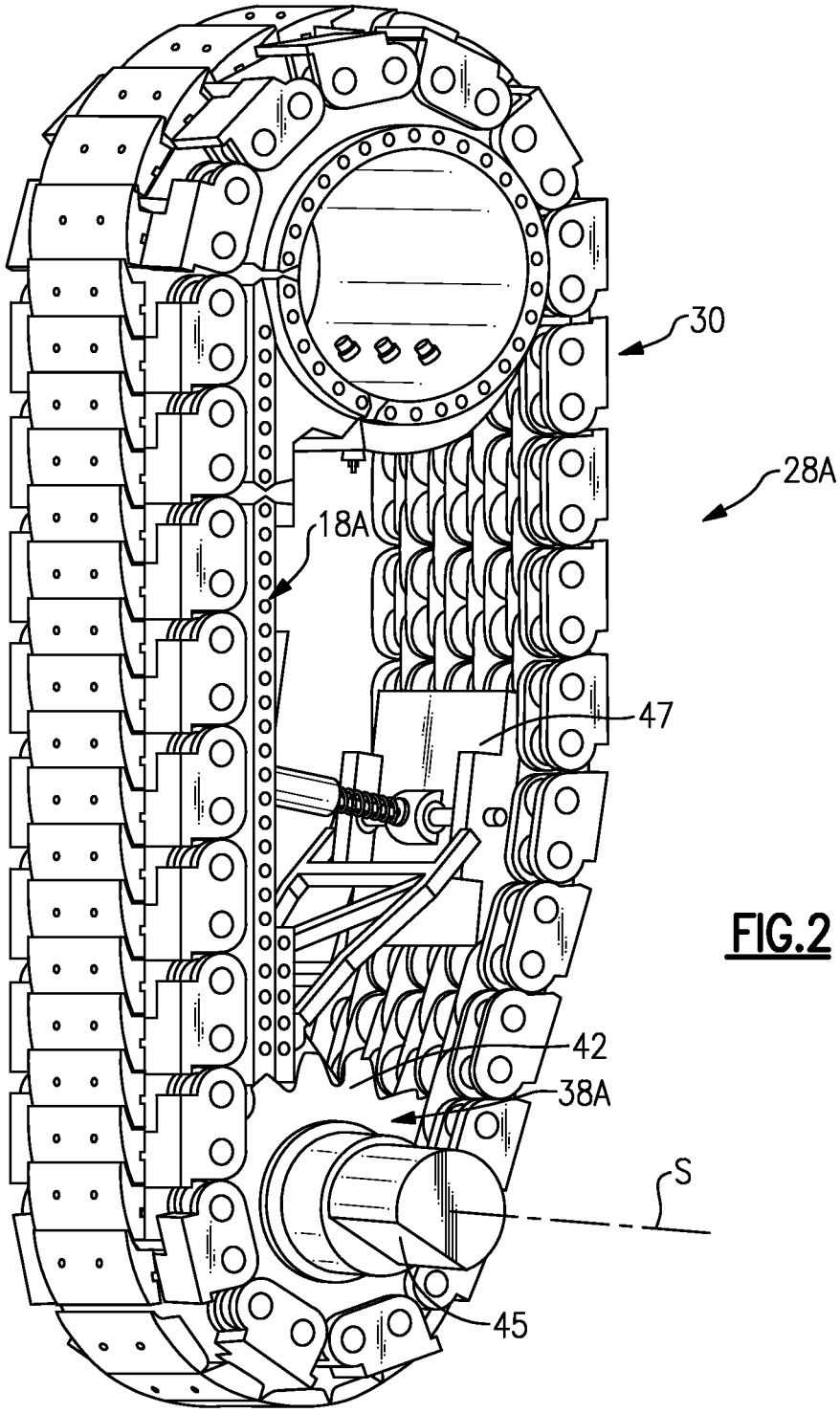
FIG. 2 is an expanded view of a track assembly for a dry coal extrusion pump.

The pump 10 generally includes an inlet 12, a passageway 14, an outlet 16, a first load beam 18A, a second load beam 18B, a first scraper seal 20A, a second scraper seal 20B, a first drive assembly 22A, a second drive assembly 22B, a valve 24, and an end wall 26. Pulverized dry coal is introduced into pump at inlet 12, communicated through passageway 14, and expelled from pump 10 at outlet 16. Passageway 14 is defined by first track assembly 28A and second track assembly 28B, which are positioned substantially parallel and opposed to each other (FIG. 2). First track assembly 28A, together with second track assembly 28B, drives the pulverized dry coal through passageway 14.

The distance between first and second track assembly 28A and 28B, the convergence half angle .theta. between load beams 18A and 18B, and the separation distance between scraper seals 20A and 20B may be defined to achieve the highest mechanical solids pumping efficiency possible for a particular dry particulate material without incurring detrimental solids back flow and blowout inside pump 10 (FIG. 1B). High mechanical solids pumping efficiencies are generally obtained when the mechanical work exerted on the solids by pump 10 is reduced to near isentropic (i.e., no solids slip) conditions.

Figure 3:
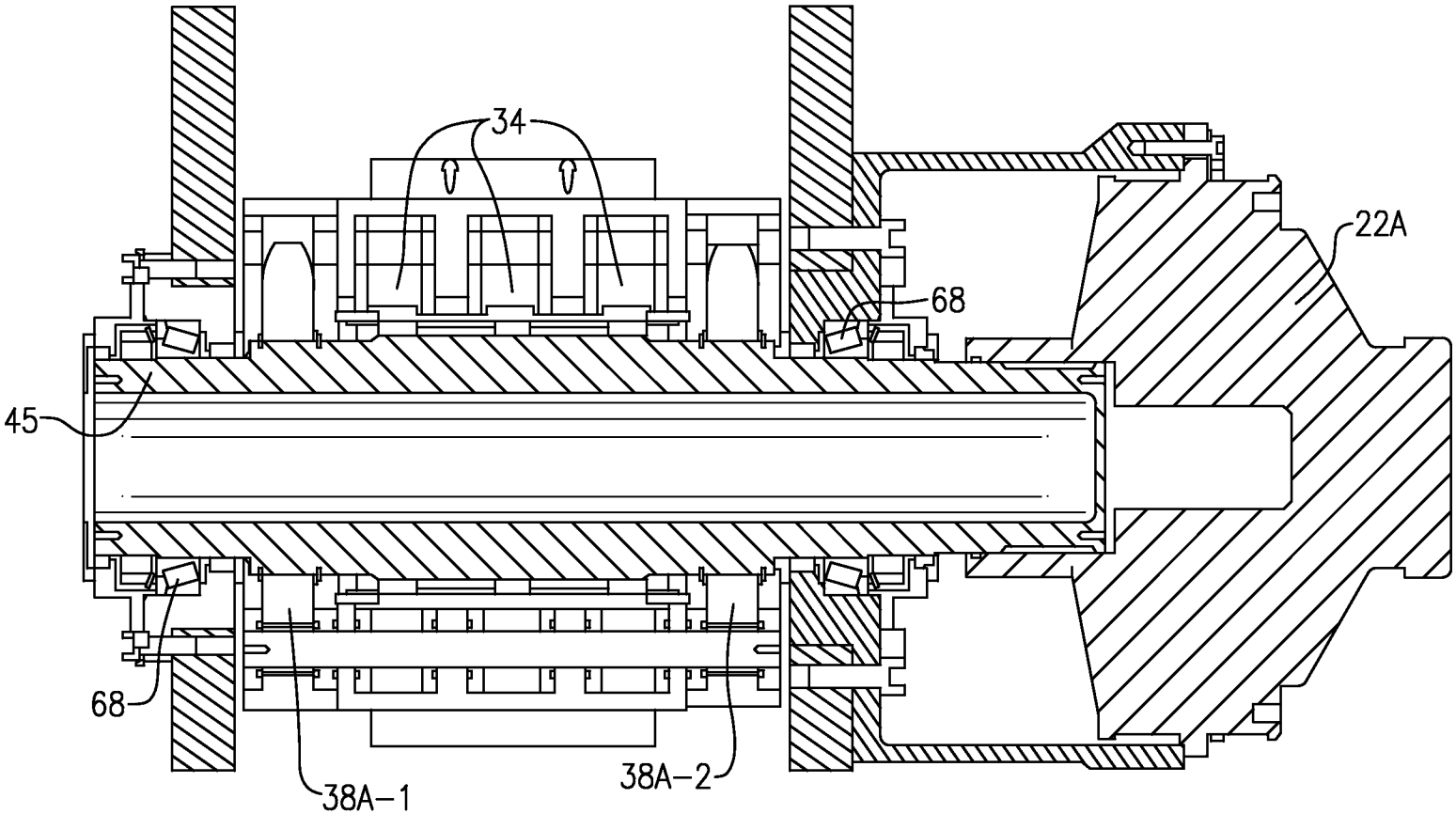
FIG. 3 is a sectional view through a drive shaft of the dry coal extrusion pump.

Each load beam 18A, 18B is respectively positioned within the track assembly 28A, 28B. The load beams 18A, 18B carry the mechanical load from each track assembly 28A, 28B to maintain passageway 14 in a substantially linear form. The load beams 18A, 18B also support the respective drive assemblies 22A which power drive shaft 45 and sprocket assembly 38A to power the respective track assembly 28A, 28B (FIG. 3). A tensioner assembly 47 may also be located within the load beams 18A, 18B to provide adjustable tension to the respective track assembly 28A, 28B.

The scraper seals 20A, 20B are positioned proximate passageway 14 and outlet 16. The track assemblies 28A, 28B and the respective scraper seals 20A, 20B form a seal between pump 10 and the outside atmosphere. Thus, the pulverized dry coal particles that become caught between track assemblies 28A, 28B and respective scraper seals 20A, 20B form a pressure seal. The exterior surface of scraper seal 20A, 20B defines a relatively small angle with respect to the straight section of the respective track assembly 28A, 28B to scrape the pulverized dry coal particle off of the moving track assembly 28A, 28B. The angle prevents pulverized dry coal stagnation that may lead to low pump mechanical efficiencies. In an exemplary embodiment, scraper seals 20A, 20B defines a 15 degree angle with the straight section of the track assemblies 28A, 28B. The scraper seals 20A, 20B may be made of any suitable material, including, but not limited to, hardened tool steel.

Valve 24 is positioned proximate outlet 16 of pump 10 and is switchable between an open position and a closed position. A slot 44 runs through valve 24 and controls whether the pulverized dry coal may pass through outlet 16 of pump 10 into a discharge tank (not shown). The width of slot 44 is larger than outlet 16 between scraper seals 20A and 20B. When valve 24 is in the closed position, slot 44 is not aligned with passageway 14 and outlet 16, it prevents the pulverized dry coal from exiting pump 10 through outlet 16. Valve 24 is typically in the closed position when first and second track assembly 28A, 28B are not rotating.

Valve 24 remains in the closed position at pump 10 start up. Once the track assembly 28A, 28B begin rotation, valve 24 may be rotated 90 degrees to the open position. When valve 24 is in the open position, slot 44 is aligned with passageway 14 and outlet 16 to communicate the pulverized dry coal in passageway 14 to flow through pump 10 and into the discharge tank. In one non-limiting embodiment, valve 24 is a cylinder valve.

It should be understood that first track assembly 28A and second track assembly 28B are generally alike with the exception that first track assembly 28A is driven in a direction opposite second track assembly 28B such that only first track assembly 28A and systems associate therewith will be described in detail herein. It should be further understood that the term "track" as utilized herein operates as a chain or belt to transport dry particulate material and generate work from the interaction between the first track assembly 28A, the second track assembly 28B and the material therebetween.

With reference to FIG. 3, first drive assembly 22A may be positioned within or adjacent to the first interior section 36A of first track assembly 28A to drive first track assembly 28A in a first direction. First drive assembly 22A includes at least one drive sprocket assembly 38A positioned at one end of first track assembly 28A. In the disclosed, non-limiting embodiment, drive sprocket assembly 38A has a pair of generally circular-shaped sprocket bases 40 with a plurality of sprocket teeth 42 which extend respectively therefrom for rotation about an axis S. The sprocket teeth 42 interact with first track assembly 28A to drive the first track assembly 28A around load beam 18A. Each drive shaft 45 is supported upon a set of tapered roller bearing assemblies 68 to react shear and normal radial loads as well as react axial loads in an upset condition. The plurality of track roller bearings 34 transfer a normal load to the load beams 18A, 18B to carry the mechanical load from each track assembly 28A, 28B. In an exemplary embodiment, first drive assembly 22A rotates first track assembly 28A at a rate of between approximately 0.5 feet per second and approximately 5 feet per second (ft/s).

Figure 4:
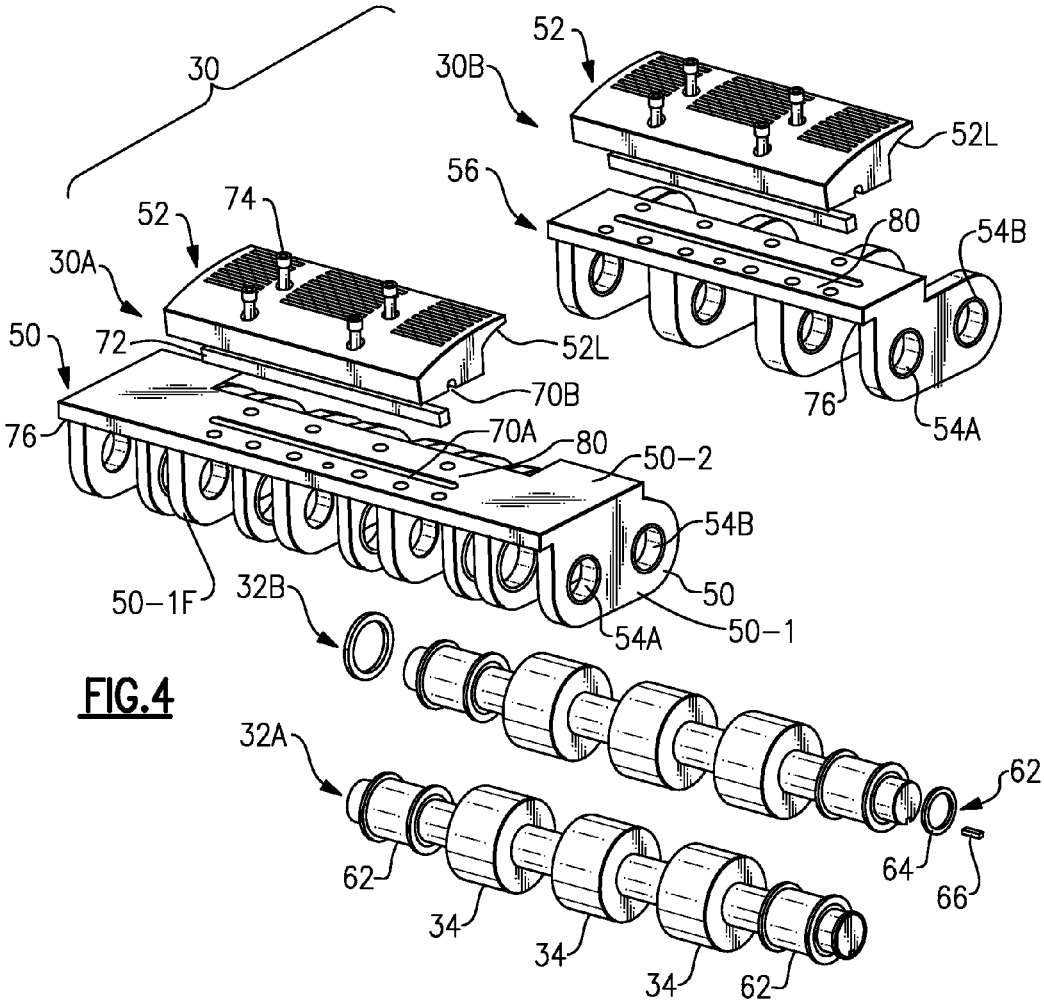
FIG. 4 is a perspective view of a link assembly.
Figure 5:
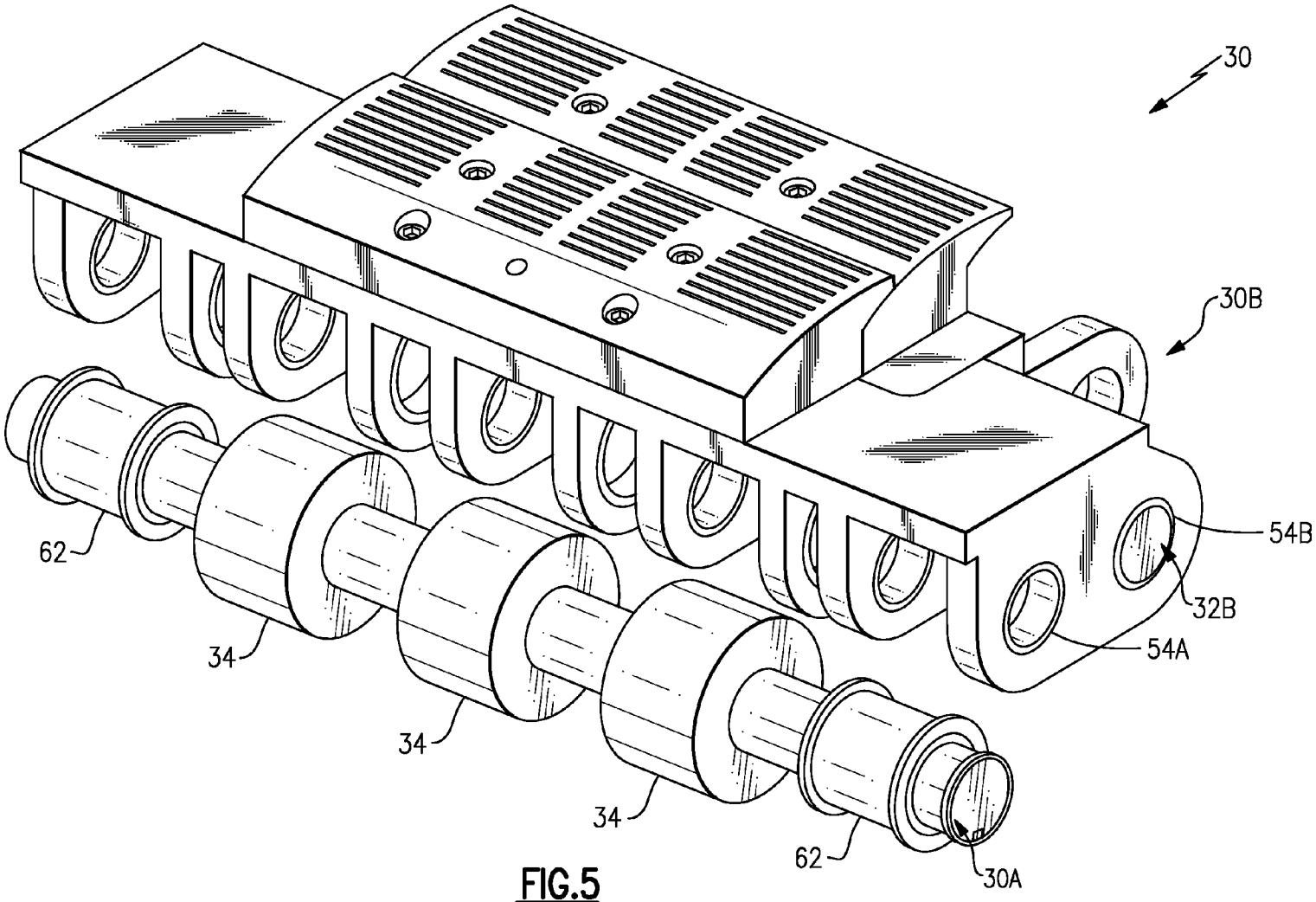
FIG. 5 is an exploded view of a link assembly.
Figure 6:
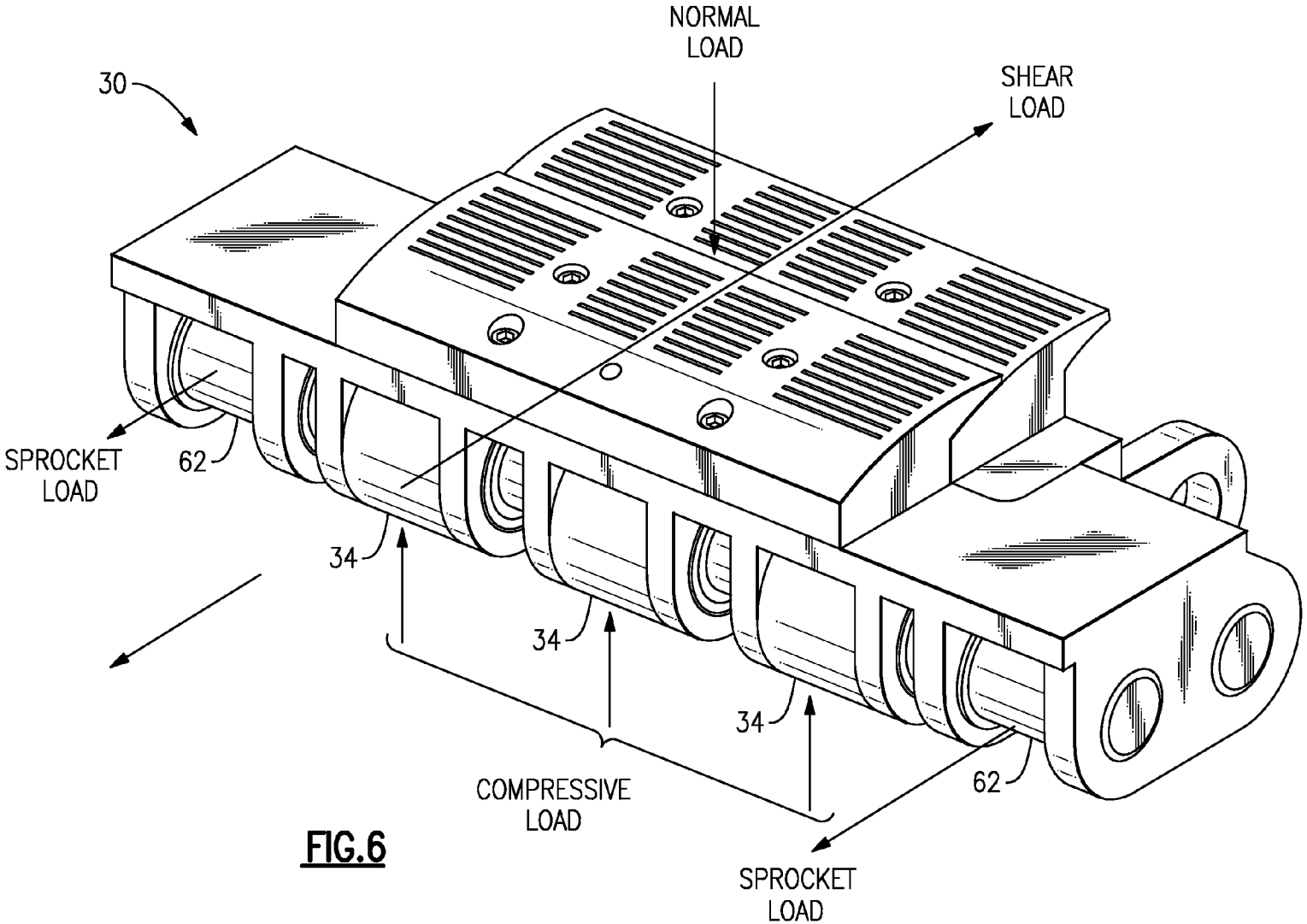
FIG. 6 is a perspective view of a link assembly illustrating loads thereon.

With reference to FIG. 4, each track assembly 28A, 28B is formed from a multiple of link assemblies 30A, 30B (one link assembly as defined herein shown assembled in FIG. 5) having a forward link assembly 30A and an aft link assembly 30B connected in an alternating continuous series relationship by a link axle 32B with a plurality of track roller bearings 34. Track roller bearings 34 are mounted to each link axle 32A, 32B and function to transfer the mechanical compressive loads normal to the link assemblies 30A, 30B into the load beam 18A (FIG. 6).

The pulverized dry coal being transported through passageway 14 creates solid stresses on each track assembly 28A, 28B in both a compressive outward direction away from passageway 14 as well as in a shearing upward direction toward inlet 12. The compressive outward loads are carried from the link assemblies 30 into link axle 32, into track roller bearings 34, and into first load beam 18A (FIGS. 3 and 6). First load beam 18A thus supports first track assembly 28A from collapsing into first interior section 36A of the first track assembly 28A as the pulverized coal is transported through passageway 14. The shearing upward loads are thereby efficiently transferred from the link assemblies 30, into link axle 32, into sprocket bushing retainer 62, into drive sprocket 38A, and drive assembly 22A (FIG. 3).

The link assemblies 30 provide for a relatively flat surface to define passageway 14 as well as the flexibility to turn around the respective drive sprocket 38A and the load beam 18A. Each of the respective plurality of forward links 30A and the aft links 30B are connected by the link axles 32 which provide for engagement with the sprocket teeth 42. The link assemblies 30 and link axles 32 may be manufactured of any suitable material, including, but not limited to, hardened tool steel.

Each forward link assembly 30A generally includes a forward link 50 and a replaceable tile 52 with an overlapping tile ledge 52L. The term "tile" as utilized herein defines the section of each link which provides a primary working surface for the passageway 14. The term "ledge" as utilized herein defines the section of each tile 52 which at least partially overlaps the adjacent tile 52. It should be understood that the ledge may be of various forms and alternatively or additionally extend from the leading edge section and/or the trailing edge section of each tile 52.

The forward link 50 is generally defined by a multiple of link plates 50-1 which are mounted to or integral with a link body 50-2 which is generally transverse thereto. The link body 50-2 is offset at least partially forward of a forward edge 50-1F of the multiple of link plates 50-1 to define a forward step 76. The link body 50-2 is illustrated herein in the disclosed non-limiting embodiment as generally a flat plate, however, various non-flat shapes may alternatively be utilized.

Each link plate 50-1 defines a multiple of axle apertures 54A, 54B. Each of the multiple of axle apertures 54A, 54B receives the respective link axle 32A, 32B to attach each respective forward link assembly 30A to an adjacent aft link assembly 30B in a continuous manner.

Figure 7:
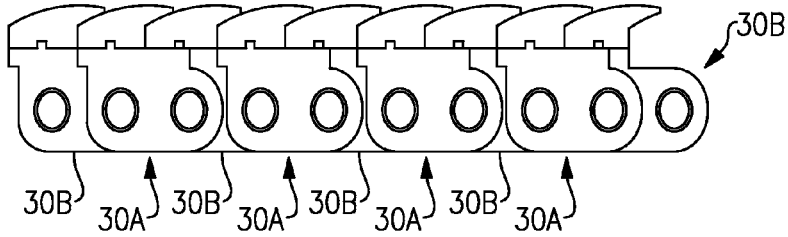
FIG. 7 is a side view of a multiple of link assemblies which define a track assembly.

The tile 52 mates with the forward link 50 upon a tile mount surface 80 such that the overlapping tile ledge 52L extends beyond the tile mount surface 80 toward the aft link aperture 54B (FIG. 7). The link body 50-2 defines the tile mount surface 80 to support the tile 52. A slot 70A within the tile 52 matches a slot 70B within the tile mount surface 80 to receive a key 72 that fits within the slots 70A, 70B so as to, for example, further resist shear forces. A multiple of fasteners 74 may retain each tile 52 in a removable manner for maintenance and wear accommodation.

Each aft link assembly 30B generally includes an aft link 56 and a replaceable tile 52 with an overlapping tile ledge 52L in a manner similar to that of the forward link assembly 30A. Whereas the aft link assembly 30B is generally the same as the forward link assembly 30A, the above description is generally applicable to the aft link assembly 30B.

By way of perspective in one non-limiting embodiment, each forward link 50 may weigh approximately 100 pounds (45 Kg.) and each aft link 56 may weigh approximately 60 pounds (27 Kg.) and each tile 52 may weigh approximately 40 pounds (18 Kg.).

Each link axle 32A, 32B supports the plurality of track roller bearings 34 and an end sprocket bushing retainer 62 upon which sprocket load is transferred (FIG. 6). A retainer ring 64 and key 66 retains the link axle 32 within the links 30A, 30B to retain the link axle 32 in place. The aft aperture 54B of the forward link assembly 30A and the forward aperture 54A of the aft link assembly 30B receives a single link axle 32 such that each overlapping tile ledge 52L at least partially overlaps the next link to define a continuous sealing surface (FIG. 7). An effective seal is thereby provided along the passageway 14 by the geometry of adjacent tiles 52 to facilitate transport of the dry particulate material with minimal injection thereof into the link assembly 30.

Figure 9:
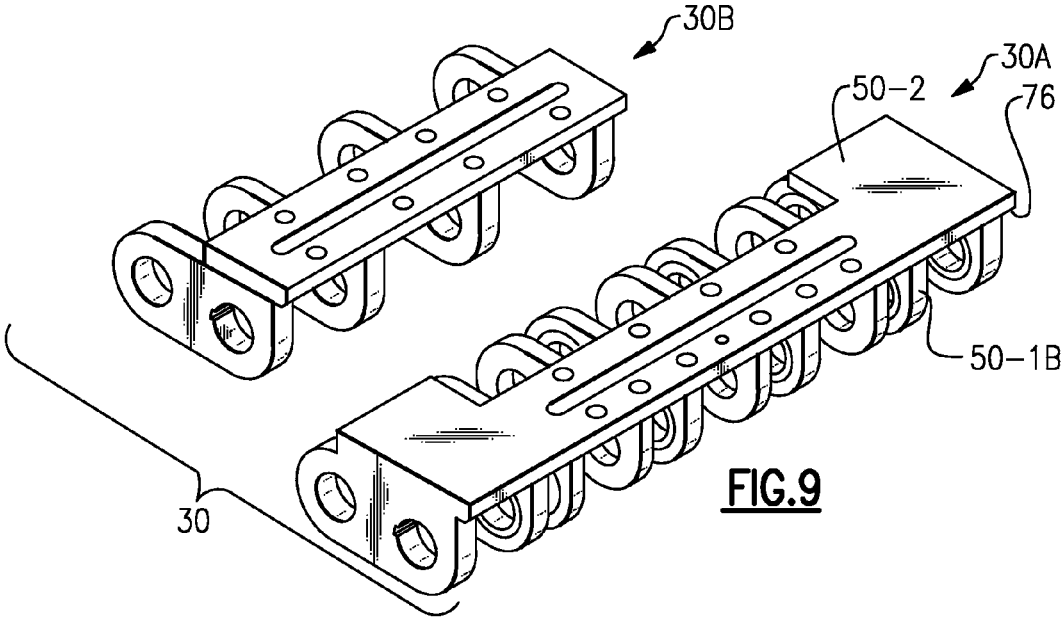
FIG. 9 is a perspective view of a link body.
Figure 10:
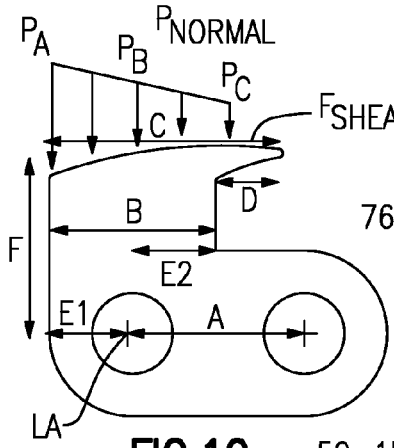
FIG.10 Related Art
FIG. 10 is a side view of a related ark link.
Figure 8:
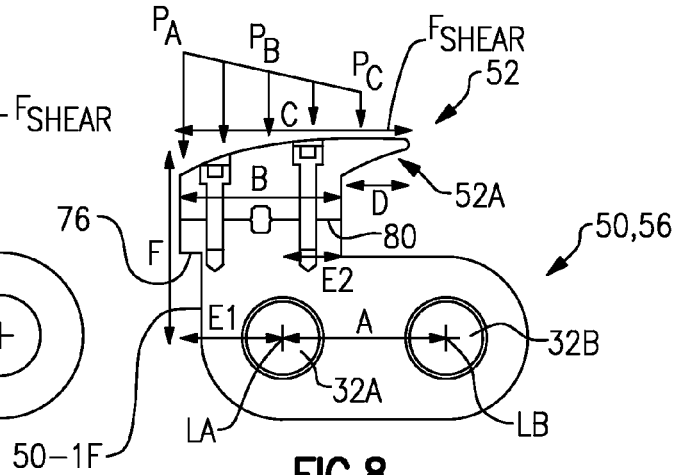
FIG. 8 is a side view of a link in accordance with one non-limiting embodiment.

With reference to FIG. 8, the forward link 50 and the aft link 56 each define a forward step 76 such that the position of the respective tile 52 (not shown in FIG. 9) is shifted forward. That is, the tile mount surface 80 is essentially shifted forward relative to axis of rotation LA defined by the forward aperture 54A relative to a conventional link (RELATED ART; FIG. 10) such that pitch dimension A between the axes LA and LB of link axles 32A, 32B and the tile mount surface 80 dimension B remain the same. Dimension E2 which is between an aft edge of the tile mount surface 80 and the axis LA of the link axle 32A is decreased.

The forward step 76 in each respective link 50, 56 facilitates a reduction of the maximum load transferred to the track roller bearings 34 through a more even balance of loads between two adjacent link axles 32A, 32B. The load on the tile 52 bears on the link 50, 56, then in turn upon the link axles 32 which are supported upon the track roller bearings 34. The forward shift of the tile mount surface 80 which forms the forward step 76 thereby reacts a relatively large overturning shear moment $F_{SHEAR}$ that would otherwise transfer most of the load into the rear link axle 32B which tends to lift the forward track roller bearings 34 of the track assembly 28A, 28B off the respective load beams 18A, 18B. In the disclosed embodiment, the forward step 76 reduces the applied maximum load through the aft link axle 32B approximately 28% as compared to the conventional link (RELATED ART; FIG. 10).

In one non-limiting embodiment, even the most unbalanced applied load moment provides a load split among the two link axles 32A, 32B of 65%-35% compared to the conventional 71%-29%. The more equal load moment upon the axles 32A, 32B provided by the shifted tile mount surface 80 disclosed herein results in an overall increase in the life of the components as the track roller bearings 34 of the track assembly 28A, 28B maintain contact at all times with the respective load beams 18A, 18B.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A link comprising:

a multiple of link plates; and a link body integral with said multiple of link plates, said link body disposed at least partially forward of a forward edge of said multiple of link plates; wherein each of said multiple plates are configured to join the link body to an adjacent link.

2. The link as recited in claim 1, wherein said link body is disposed forward of said forward edge of said multiple of link plates to reduce a moment about said link body, the moment based on a shear force on said link body.

3. The link as recited in claim 1, wherein each of said multiple of link plates define a forward axle aperture and an aft axle aperture.

4. The link as recited in claim 3, further comprising a tile mountable to said link body, said tile includes an overlapping tile ledge that extends toward said aft axle aperture.

5. The link as recited in claim 3, further comprising a tile mountable to said link body, a forward edge of said tile forward of said forward aft axle aperture.

6. The link as recited in claim 1, further comprising a tile mountable to said link body, a forward edge of said tile aligned with a forward edge of said link body.

7. The link as recited in claim 1, wherein each of said multiple of link plates is perpendicular to said link body.

8. A link assembly comprising:

a multiple of link plates; and a link body attached to said multiple of link plates, said link body disposed at least partially forward of a forward edge of said multiple of link plates; wherein each of said multiple plates are configured to join the link body to an adjacent link.

9. The link assembly as recited in claim 8, wherein said link body is disposed forward of said forward edge of said multiple of link plates to reduce a moment about said link body, the moment based on a shear force on said link body.

10. The link assembly as recited in claim 8, wherein each of said multiple of link plates define a forward axle aperture and an aft axle aperture.

11. The link assembly as recited in claim 10, further comprising a tile mountable to said link body.

12. The link assembly as recited in claim 10, further comprising a tile mountable to said link body, a forward edge of said tile aligned with a forward edge of said link body.

13. The link assembly as recited in claim 12, wherein said link body defines a link body slot.

14. The link assembly as recited in claim 13, wherein said tile defines a tile slot, said tile mountable to said link body such that said tile slot and said link body slot receives a key.

15. The link as recited in claim 1, wherein said link body includes opposing laterally outer edges, and at least some of said multiple of link plates are spaced from each of said opposing laterally outer edges.

16. The link as recited in claim 1, wherein said multiple of link plates and said link body are portions of a continuous monolithic structure.

17. The link as recited in claim 1, wherein said multiple of link plates are transverse to an axis of rotation of said multiple of link plates during operation.

18. The link as recited in claim 3, wherein said forward axle aperture and said aft axial aperture each receive a link axle to attach said link body and said multiple of link plates to an adjacent link.

19. The link assembly as recited in claim 10, wherein said multiple of link plates and said link body are portions of a continuous monolithic structure.

20. The link assembly as recited in claim 10, wherein said forward axle aperture and said aft axial aperture are to receive a link axle to attach said link body and said multiple of link plates to another link assembly.

* * * * *